United States Patent [19]

Wagner

[11] 4,124,978

[45] Nov. 14, 1978

[54] COMPRESSED AIR ENGINE

[76] Inventor: William C. Wagner, 47 Jamaica Ave., Plainview, N.Y. 11803

[21] Appl. No.: 608,032

[22] Filed: Aug. 27, 1975

Related U.S. Application Data

[63] Continuation-in-part of Ser. No. 473,420, May 28, 1974, abandoned.

[51] Int. Cl.[2] ..... F01B 29/00

[52] U.S. Cl. ..... 60/410; 60/412; 60/418; 91/454; 91/273; 92/127; 92/162 R; 184/11 D

[58] Field of Search ..... 60/407, 408, 409, 410, 60/412, 370, 371, 413, 415, 416, 417, 418; 180/65 A, 66 B; 92/127, 162; 91/454, 457, 273; 184/11 D

[56] References Cited

U.S. PATENT DOCUMENTS

| | | | |
|---|---|---|---|
| 931,643 | 8/1909 | Pittman et al. | 60/412 |
| 1,347,805 | 7/1920 | Feagan | 60/412 |
| 1,847,418 | 3/1932 | Steedman | 184/11 D |
| 2,244,384 | 6/1941 | Bissinger | 60/416 X |
| 2,729,307 | 1/1956 | Perrin | 184/11 D |
| 2,966,776 | 1/1961 | Taga | 60/412 X |
| 3,379,008 | 4/1968 | Manganaro | 60/408 X |
| 3,765,180 | 10/1973 | Brown | 60/370 |
| 3,885,387 | 5/1975 | Simington | 60/412 |
| 3,925,984 | 12/1975 | Holleyman | 60/412 |

*Primary Examiner*—Allen M. Ostrager
*Attorney, Agent, or Firm*—Eisenman, Allsopp & Strack

[57] ABSTRACT

A compressed air engine having specially designed cylinder heads and piston configurations in order to reduce friction and maximize the application of air from a pressurized air source. The disclosure includes a lubrication system whereby the mechanical parts receive oil via a lubrication arrangement including a conveyor chain continually bathed in oil.

13 Claims, 7 Drawing Figures

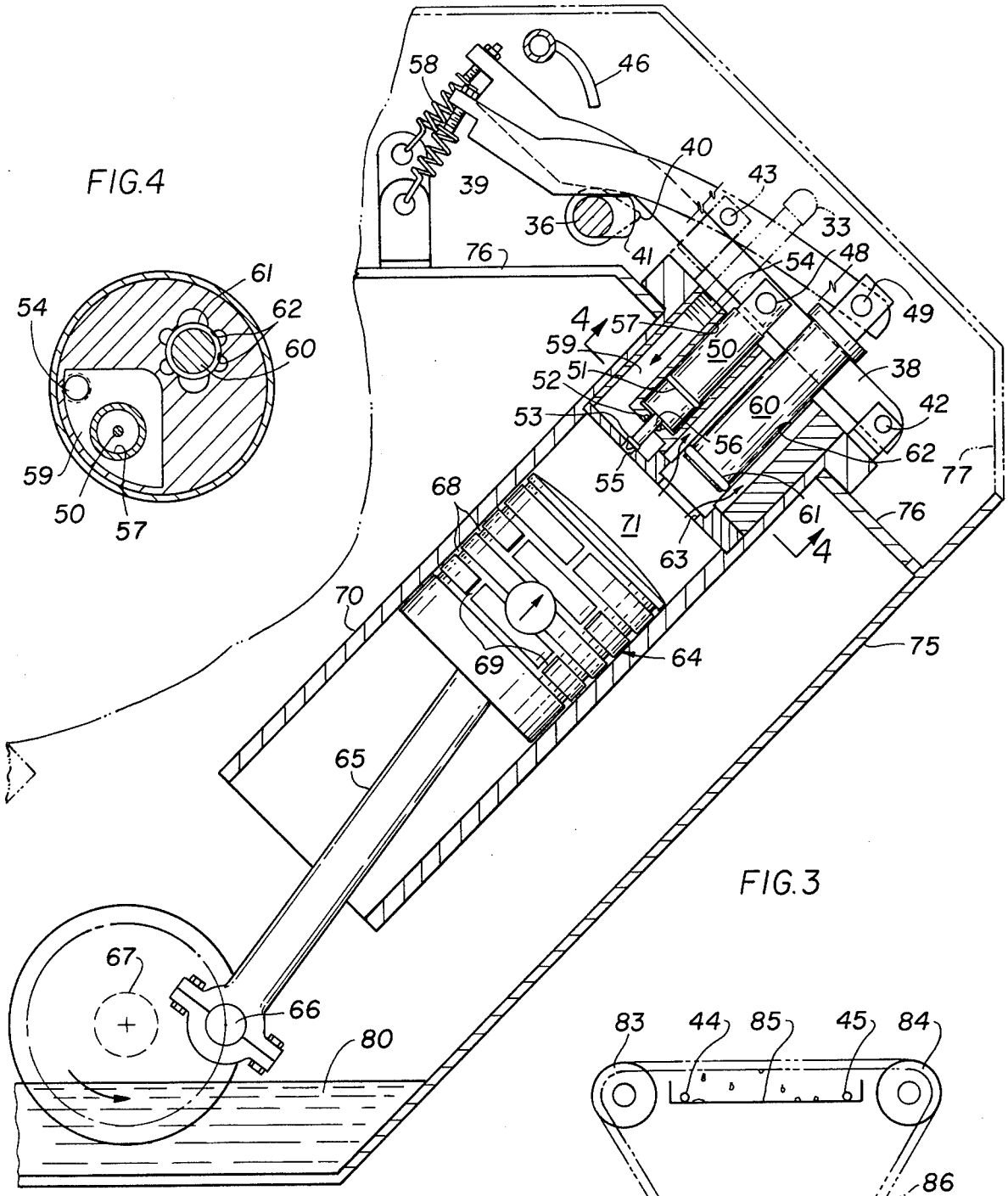
FIG.4
FIG.3
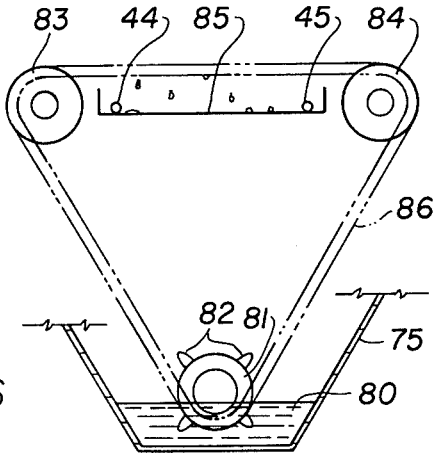
FIG.6

COMPRESSED AIR ENGINE

RELATED APPLICATIONS

This is a continuation-in-part of co-pending application Ser. No. 473,420, filed May 28, 1974 now abandoned.

BACKGROUND OF THE INVENTION

1. Field of the Invention

This invention relates generally to compressed air engines and more particularly to improved compressed air engines having specially designed components which maximize utilization of the air and minimize friction.

2. Description of the Prior Art

Compressed air engines have been made in various forms for many years. Such engines have long found applicability in volatile atmospheres where the ignition of gaseous engines is intolerable. The basic components of such engines include cylinders, reciprocating pistons, means for selectively supplying air under pressure to the cylinders, and exhausting the air after extracting the pressure. It is also common practice to drive such engines from a storage source of air under pressure, which is replenished, or kept within a desired pressure range by means of a compressor.

Such engines require an external source of power in order to initiate operation in many instances, and also in order to make-up for the necessary depletion of air and drop in pressure during operation. It is essential to minimize friction in this type of engine to recycle the input energy for as long as possible, and to efficiently store any unused energy, in order to achieve the greatest performance.

Internal combustion engines have been employed in the past to produce the necessary compressed air, but the inherent atmospheric pollution of such engines is objectionable. It has been demonstrated that electrically powered compressors may be advantageously used to avoid pollution and this suggests ease of installation in fixed locations, or suitability for mobile use with rechargeable batteries.

SUMMARY OF THE INVENTION

The present invention is embodied in a multiple cylinder compressed air engine driven via a drive tank of compressed air. A primary air storage tank of greater volume than the drive tank, contains air at greater pressure than the drive tank which is maintained within a predetermined pressure range by means of a compressor driven with either a diesel engine or an electric motor. When a motor is used, an electric battery supplies current to the motor, a generator is directly driven by the compressed air engine in order to supply recharging current to the battery and alternatively provide power for the compressor, and a heavy drive shaft is employed to store energy and smooth out operation.

It is an object of the present invention to provide an improved compressed air engine.

Another object of the invention is to provide an improved compressed air engine with a high capacity for recycling any undissipated energy during normal operation.

Another object of the invention is to provide such an engine with a plurality of cylinders each having pistons mounted for reciprocating motion and spaced from the cylinder walls by a cushion of air.

It is another object of the invention to provide an improved compressed air engine having uniquely designed cylinder heads in order to maximize the input and exhaust of air to and from the cylinders.

In accordance with a particular embodiment of the invention there is provided a compressed air engine including a source of air under pressure, and at least one cylinder assembly comprising: a cylinder, a piston mounted for reciprocating motion in the cylinder, and a cylinder head having input and output valve means. The input valve means include an auxiliary chamber interposed between the source of air under pressure and the cylinder. The input valve means also includes a valve member operative to cyclically admit air from the auxiliary chamber to the cylinder in order to drive the piston.

In accordance with another aspect of the invention, there is provided a piston structure including circumferential grooves encircling the piston walls and axial grooves interconnecting the circumferential grooves. The wall surfaces of the pistons are dimensioned for slight clearance within the cylinder. Thus, upon introduction of air through the cylinder head, the major force of the air acts upon the piston face, but a small portion of this air traverses the grooves in the side walls of the piston. As a result, the piston in effect, floats free within the cylinder and in so doing reciprocates without frictional contact against the cylinder walls.

In accordance with yet another aspect of the invention, a compressed air engine embodying the features of the invention is provided with a complete lubricating system. A principal component of the lubricating system is a continuous chain driven by the drive shaft and immersed in an oil bath at the lowermost portion of its travel. The lubricating chain deposits oil at the upper portion of its travel into a drain pan connected by oil ducts or conduits to each of the major frictional points of the engine.

A more complete appreciation and understanding of the invention will be available from the following text and the accompanying drawings.

BRIEF DESCRIPTION OF THE DRAWINGS

FIG. 3 is a vertical cross-sectional view taken along the lines 3—3 of FIG. 4, illustrating the structure of a typical cylinder head embodying the features of the invention;

FIG. 4 is a cross-section taken along lines 4—4 of FIG. 3;

FIG. 6 is an illustration of the oil lubrication system located behind the front cover of the engine shown in FIG. 2.

DESCRIPTION OF THE PREFERRED EMBODIMENTS

Figure 1:
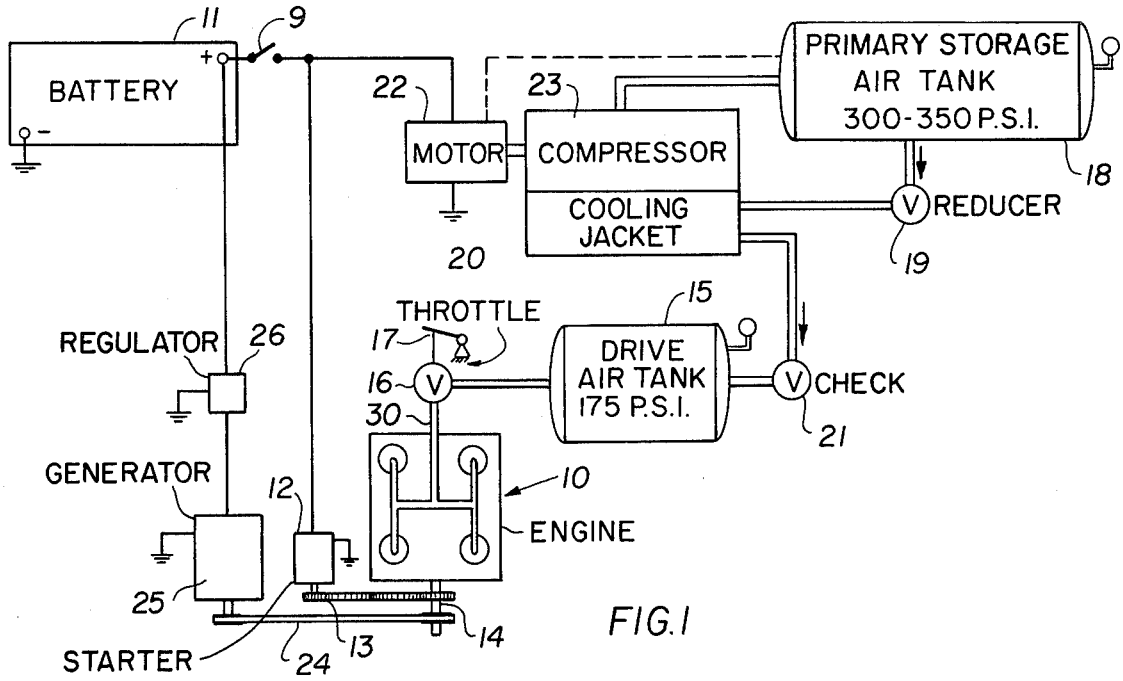
FIG. 1 is a block schematic showing the principal components of a compressed air engine embodying the invention.

FIG. 1 shows the interconnections and relationships of the principal components of the compressed air engine of the preferred embodiment. The engine block 10 appears in the lower central portion of the FIGURE. Switch 9 controls the engine and is closed to establish an electric circuit from battery 11 to starter motor 12. Starter motor 12 is coupled via gears 13 to the crank shaft 14 of the engine in a manner similar to that customary with conventional internal combustion engines. Operation of the starter motor 14 is effective to turn over the engine and thereafter it continues running as long as air under pressure is applied. Once the engine is started, starter motor 14 is disengaged by means, for example, of a conventional centrifugal clutch.

Drive tank 15 supplies air to the cylinders. It has been found desirable to operate this drive tank at a constant pressure of approximately 175 lbs. per square inch. The air from tank 15 is applied through throttle valve 16 to an input conduit 30. Valve 16 controls the amount of air supplied to the engine in accordance with the position of a throttle lever 17; the linkage and operation being advantageously similar to that found on the gas pedal for conventional internal combustion engines.

Drive tank 15 is maintained at pressure by a primary storage tank 18 which contains air under a pressure which ranges in a particular embodiment between 300 and 350 lbs. per square inch. Air from the primary storage tank is applied through a pressure reducer valve 19 and cooling jacket 20 to a check valve 21 at the input of the drive tank 15. Cooling jacket 20 may not be essential; however, the inherent cooling available as a result of the expansion of the air as it comes out of reducer valve 19, can be used to reduce the heat developed within compressor 23.

The pressure of the air within the primary storage tank 18 is maintained within the desired range by a compressor 23 that is driven by electric motor 22. The compressor motor 22 is directly connected to battery 11 via switch 9 and is energized whenever the pressure in the primary storage tank falls below 300 lbs. per square inch. The pressure actuated enabling switch for motor 22 is not illustrated in the drawings; however, such switches are familiar to those skilled in the art. Alternatively, motor 22 may be replaced by a diesel engine that is completely independent of the compressed air engine. This diesel engine will simply operate to maintain the pressure within prescribed ranges.

In order to reduce battery drain, a generator or alternator 25 is directly coupled to the crank shaft 14 via a pulley and belt system 24. The output of generator 25 is connected through regulator 26 in order to supply charging current to battery 11, as required. It will be understood that compressor 23 is driven by motor 22 only during those times that the pressure in the primary storage tank is below 300 lbs. per square inch. Generator 25 effectively supplies charging current to battery 11, as is in parallel with the battery in supplying the compressor motor when it is energized. The capacity of compressor 23 and generator 25, and the volume of primary storage tank 18 and drive tank 15, are selected in accordance with the load to be driven by the compressed air engine and the operating periods contemplated.

The use of crank shaft energy to assist in battery recharging and compressor operation, may be likened to the centrifugal energy storage units and used successfully in some bus and trolley systems. Clearly, if the present engine is installed to drive mobile units, under some conditions (e.g. going down hills) positive energy input will be available from the crank shaft to the engine. Obviously, frictional forces will deplete the energy initially supplied, either by electrical means, compressed air, or diesel fuel input; however, it has been found that the described system does afford advantages in this type of compressed air engine.

Figure 2:
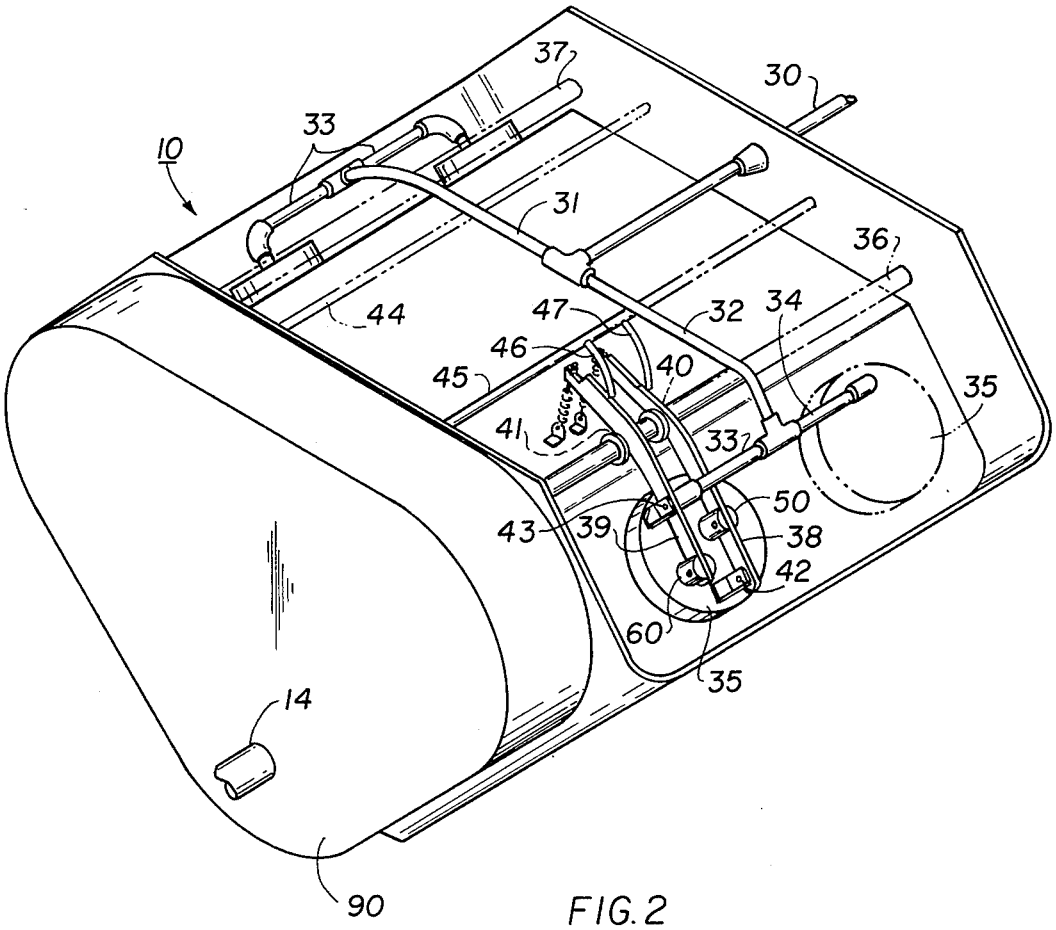
FIG. 2 is a perspective illustration of a compressed air engine embodying the invention and showing typical components and their relative positions.
Figure 5:
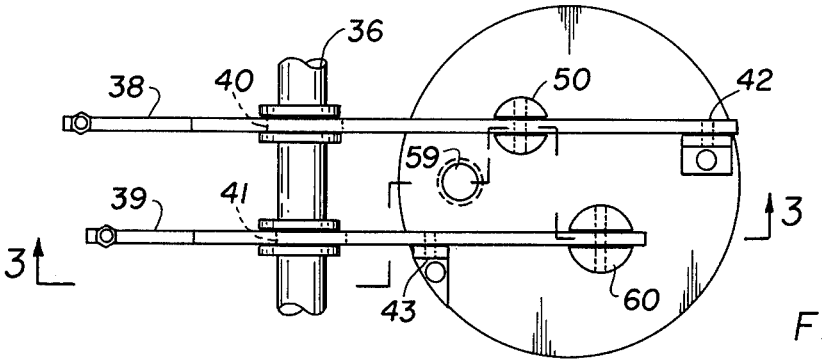
FIG. 5 is a top view showing the cams, cam followers and cylnder head of a typical cylinder embodying the features of the invention.

The principal components on the engine block 10, are visible in the perspective view of FIG. 2 which reveals the front, top, and upper right side of the block, with the front cover 90 in place, and the top cover 77 removed. For simplicity of illustration, a 4 cylinder V-type engine is depicted. The cams, cam followers, and cylinder head for a single cylinder only, are shown in detail.

The air supplied by conduit 30 is divided at a T-joint into conduits 31 and 32 for distribution to the cylinders on the opposite sides of the block. On each side of the block, the air is distributed via separate conduits, e.g. 33, 34, individual to each cylinder. A camshaft 36, 37 extends along each side of the engine. Cams, e.g. 40, 41, are mounted upon the camshafts and controls the positions of cam followers e.g. 38, 39, respectively. The cam followers 38, 39 are pivotally coupled at the cylinder head and determine the relative position of the input and output valve means 50, 60.

FIG. 2 also illustrates a segment of the oil distribution system designed to lubricate the cams and cam followers. Thus, tubing 44 and 45 will be seen extending along each side of the engine. Distribution points are available at each cylinder as illustrated on the first cylinder by drain tubes 46, 47 disposed over cam followers 38, 39. FIG. 6 shows the manner in which oil is supplied to tubing 44 and 45 and this will be discussed in detail hereinafter. It may be noted in passing that all oil distributed to the upper portion of the engine will be collected within the housing and returned to an oil bath at the bottom front of the block, from which it is recirculated.

The cross-sectional views of FIGS. 3 and 4 show the interior of the typical first cylinder located on the right hand side of the engine block. This cylinder is positioned within the lower housing 75 and the cylinder head is supported upon upper housing plate 76. An upper housing cover 77 is illustrated in phantom outline.

The principal components of the cylinder assembly include the cylinder 70, piston 64 mounted for reciprocation within the cylinder, auxiliary air input chamber 59, the input valve assembly 50–57, and the exhaust valve assembly 60–63. Piston 64 is connected by rod 65 and coupling 66 to the crank shaft 67 in conventional manner for the conversion of the reciprocating motion of the piston to rotary motion of the shaft.

Air is supplied under pressure to input port 54 of auxiliary input chamber 59 by conduit 33. Chamber 59 extends axially throughout approximately one quadrant of the cylinder head. The input valve assembly occupies a separate cylindrical passage 57 within the auxiliary input chamber. The input valve assembly includes valve element 50; O-ring seal 51 bearing against the walls of passage 57; seal 53 on the end of valve 50 for seating within valve aperture 55; and O-ring 52 embedded within guide aperture 56 to guide and seal the valve stem against escape of air. The position of the input valve is controlled by cam lever 38 which is connected to the valve at coupling 48 and is also pivotally connected at 42 to the block. The opposite end of cam lever 38 is secured to the block via a spring 58. Between pivot 42 and spring 58, cam follower 38 bears against cam 40 which is mounted upon camshaft 36. The configuration of cam 40 and follower 38 is such that valve 50 is opened selectively to admit air when piston 64 is near the upper portion of its stroke. The particular timing and operation of the valve will be described in more detail in connection with FIG. 7.

Exhaust valve 60 is disposed within a fluted cylindrical channel 62 in the cylinder head. An O-ring 61 is provided at the lower extremity of valve 60 for sealing the cylinder exhaust aperture 63. The valve element 60 reciprocates in sliding contact with the inner surfaces of fluted cylindrical channel 62, and the fluted portions provide for the passage of air, such that when element 60 is in the retracted position shown, air is exhausted along the paths shown by the arrows. As illustrated, piston 64 is completing its upward stroke. In a short while, this stroke will be fully completed and exhaust valve 60 will close. This will be seen to result as camshaft 36 rotates in a counterclockwise direction.

To reduce friction within the cylinder, piston 64 is provided with grooves or slots 66, 69 on its outer surface. These grooves permit the escape of small amounts of air around the entire circumference of the piston. This air acts to keep piston 64 in a floating condition so that there is either no frictional contact or minimal frictional contact, with the interior wall of cylinder 70. In particular, piston 64 is provided with circumferential grooves 68 extending about its entire perimeter. Axial grooves 69 interconnect each of the circumferential grooves and they are staggered on successive sections in order to avoid short circuiting of the air flow past the piston.

Figure 7:
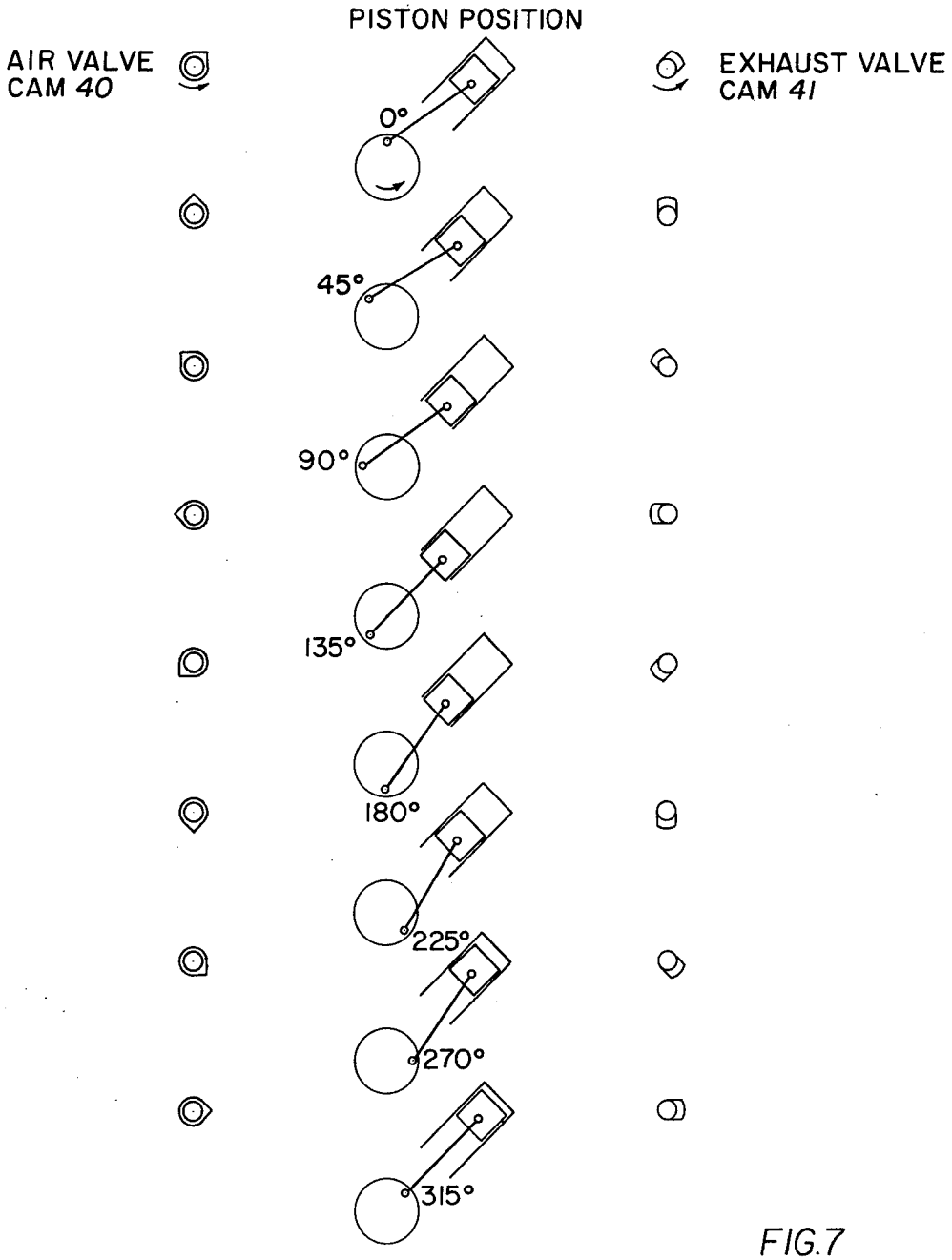
FIG. 7 is diagrammatic chart showing the approximate position of the cams and the piston associated with a typical cylinder throughout a complete operating cycle of an engine embodying the features of the invention.

FIG. 7 is arranged with the rotational position of the air valve cam 40 depicted in the left-hand column, the position of piston 64 via-a-vis the rotational position of the crank shaft 67 in the central column, and the position of the exhaust valve cam 41 in the right hand column. Succeeding rows in this FIGURE suggest successive drive shaft rotational positions starting at an arbitrary 0° and proceeding in 45° increments.

The first row in FIG. 7 illustrates the 0° position where piston 64 has just passed top dead center and is beginning to move downward. Air valve 50 is beginning to open and exhaust valve 60 has closed.

In the 45° position of the drive shaft, air valve 50 is fully opened and exhaust valve 60 remains closed. Air is consequently admitted under pressure into the chamber 71 formed by the upper portion of the cylinder and the piston face. This pressure forces the piston downward and in turn applies torque to the drive shaft.

In the 90° position of the crank shaft, air valve 50 closes. Exhaust valve 60 remains closed. The air valve will continue in this closed condition until the drive shaft has completed rotation and piston 64 has again begun to descend. This is pictorially illustrated in the remaining segments of FIG. 6.

At the 135° position, piston 64 begins its upward motion, and exhaust valve 60 is opened. During the entire upward portion of its travel, the exhaust valve is kept in its opened condition. Shortly before air is admitted, i.e. at approximately 45°, exhaust valve 60 is again closed. The particular timing at which the various valves open and close is of course controlled by the configuration of cams 40 and 41.

Yet another feature of the present invention relates to a lubrication system in accordance with which the liquid lubricant, is distributed from a reservoir at the bottom of engine housing 75 to the various cams and upper engine surfaces. The partial front elevation view of FIG. 6 shows the front of the engine with the front cover removed. As illustrated schematically in this FIGURE, a chain 86 is engaged through gear 81 to be driven by crank shaft 67 and is trained over two idler gears 83, 84. A fan-like member 82 is coupled to the drive gear 81, and as the chain dips into reservoir 80 the lubricant is forced into direct contact with it. As chain 86 traverses the upper portion of its travel between idler gears 83 and 84, the lubricant drains off into distribution tray 85 from whence it is distributed via conduits 44 and 45 to selected points on the engine. Weep holes are provided in the engine housing to permit all oil to regain its original position within reservoir 80.

Engines embodying the features of this invention are suitable for a variety of uses. While a four cylinder V-type model has been constructed and described herein, other configurations are possible and in particular situations may be desirable. These engines may be employed as prime movers for vehicles or for stationary applications. The specific use of the equipment will dictate the specifications for the battery, compressor, air storage tanks, generator, etc.

Under no circumstances, should one consider these engines to be capable of perpetual motion. However, by utilizing the structures described herein, an improved compressed air engine is available for industrial and commercial use.

A particular embodiment of the invention has been shown and described. Various specific features of the invention regarding the unique cylinder head configuration, drive arrangement, and lubrication system have been detailed. Modifications will become immediately apparent to those skilled in the art. Any such modifications within the spirit and teachings of this invention are intended to be covered by the following claims.

What is claimed is:

1. A compressed air engine having a source of air under pressure, comprising: an electrically driven compressor for maintaining said pressure above a predetermined level, an air storage tank, means for supplying air from said source to said storage tank to maintain the pressure in said tank at a desired level below said predetermined level, at least one cylinder having a reciprocating piston therein, means for selectively supplying air from said tank to said cylinder to drive said piston, a crank shaft coupled to said piston and rotatably driven responsive to the reciprocating motion of said piston, means coupled to said crank shaft to supply power to said compressor, and further means operative independently of said crank shaft to supply power to said compressor, wherein said means for supplying air to said cylinder comprises: a cylinder head, an auxiliary chamber in said cylinder head, conduit means for connecting said tank to said auxiliary chamber, and input valve means operative to periodically admit air from said auxiliary chamber into the chamber formed by said cylinder head and the top of said piston, the periodicity of said admission of air being synchronized with the rotation of said crank shaft.

2. A compressed air engine in accordance with claim 1, wherein said auxiliary chamber is disposed within an axially extending sector of said cylinder head; said input valve means includes a reciprocating valve element in a sealed cylinder positioned within said auxiliary chamber; an aperture permits air flow between said auxiliary chamber and the chamber formed by the cylinder head and the top of the piston; said valve element sealingly seats in said aperture; and cam means are coupled to said crank shaft to control operation of said valve element.

3. A compressed air engine in accordance with claim 2, wherein said auxiliary chamber occupies approximately one quadrant of the cross-section of said cylinder.

4. A compressed air engine in accordance with claim 1, further comprising: exhaust valve means in said cylinder head operative to periodically exhaust air from the chamber formed by said cylinder head and the top of said piston, the periodicity of said exhaustion of air being synchronized with the rotation of said crank shaft.

5. A compressed air engine in accordance with claim 4, wherein said exhaust valve means comprises a fluted axially extending channel terminating in a circular aperture of diameter substantially equal to the internal diameter of said channel, and a reciprocating valve element within said channel adapted to seal said circular aperture when seated therein.

6. A compressed air engine in accordance with claim 5, wherein said auxiliary chamber is disposed within an axially extending sector of said cylinder head; said input valve means includes a reciprocating valve element in a sealed cylinder positioned within said auxiliary chamber; an aperture permits air flow between said auxiliary chamber and the chamber formed by the cylinder head and the top of the piston; said valve element sealingly seats in said aperture; and cam means are coupled to said crank shaft to control operation of said valve element.

7. A compressed air engine in accordance with claim 1, wherein said piston has an outside diameter slightly less than the inside diameter of said cylinder, a plurality of axially spaced circumferential grooves encircle the piston walls, and axially extending grooves interconnect adjacent circumferential grooves, whereby a small amount of the air admitted into the chamber formed by the cylinder head and top of said piston exits via said grooves and maintains a separation between the piston and cylinder walls.

8. A compressed air engine in accordance with claim 7, wherein said means for supplying air to said cylinder comprises: a cylinder head, an auxiliary chamber in said cylinder head, conduit means for connecting said tank to said auxiliary chamber, and input valve means operative to periodically admit air from said auxiliary chamber into the chamber formed by said cylinder head and the top of said piston, the periodicity of said admission of air being synchronized with the rotation of said drive shaft.

9. A compressed air engine in accordance with claim 8, further comprising: exhaust valve means in said cylinder head operative to periodically exhaust air from the chamber formed by said cylinder head and the top of said piston, the periodicity of said exhaustion of air being synchronized with the rotation of said crank shaft.

10. A compressed air engine having a source of air under pressure, comprising: an electrically driven compressor for maintaining said pressure above a predetermined level, an air storage tank, means for supplying air from said source to said storage tank to maintain the pressure in said tank at a desired level below said predetermined level, at least one cylinder having a reciprocating piston therein, means for selectively supplying air from said tank to said cylinder to drive said piston, a crank shaft coupled to said piston and rotatably driven responsive to the reciprocating motion of said piston, means coupled to said crank shaft to supply power to said compressor, and further means operative independently of said crank shaft to supply power to said compressor, wherein said means for supplying air to said cylinder comprises: a cylinder head, an auxiliary chamber in said cylinder head, conduit means for connecting said tank to said auxiliary chamber, and input valve means operative to periodically admit air from said auxiliary chamber into the chamber formed by said cylinder head and the top of said piston, the periodicity of said admission of air being synchronized with the rotation of said crank shaft, further comprising a reservoir containing lubricant located at the bottom of said engine, a lubricant conveyor traversing a path through said reservoir and driven by said crank shaft, a pan disposed below an upper portion of said path and above the major components of the engine for receiving lubricant from said conveyor and conduit means connected to said pan for gravity distribution of said lubricant to selected locations.

11. A compressed air engine in accordance with claim 10, wherein said piston has an outside diameter slightly less than the inside diameter of said cylinder, a plurality of axially spaced circumferential grooves encircle the piston walls, and axially extending grooves interconnect adjacent circumferential grooves, whereby a small amount of the air admitted into the chamber formed by the cylinder head and top of said piston exits via said grooves and maintains a separation between the piston and cylinder walls. .

12. A compressed air engine in accordance with claim 11, wherein said means for supplying air to said cylinder comprises: a cylinder head, an auxiliary chamber in said cylinder head, conduit means for connecting said tank to said auxiliary chamber, and input valve means operative to periodically admit air from said auxiliary chamber into the chamber formed by said cylinder head and the top of said piston, the periodicity of said admission of air being synchronized with the rotation of said drive shaft.

13. A compressed air engine in accordance with claim 12, further comprising: exhaust valve means in said cylinder head operative to periodically exhaust air from the chamber formed by said cylinder head and the top of said piston, the periodicity of said exhaustion of air being synchronized with the rotation of said drive shaft.

* * * * *